US006084348A

United States Patent [19]

Love

[11] Patent Number: 6,084,348

[45] Date of Patent: Jul. 4, 2000

[54] LAMP HAVING SPECIFIC FILL PROVIDING REDUCED RESTRIKE TIME

[75] Inventor: Wayne G. Love, Glen Ellyn, Ill.

[73] Assignee: Fusion Lighting, Inc., Rockville, Md.

[21] Appl. No.: 09/367,702

[22] PCT Filed: Aug. 13, 1998

[86] PCT No.: PCT/US98/16822

§ 371 Date: Aug. 20, 1999

§ 102(e) Date: Aug. 20, 1999

[87] PCT Pub. No.: WO99/08865

PCT Pub. Date: Feb. 25, 1999

Related U.S. Application Data

[60] Provisional application No. 60/055,293, Aug. 13, 1997.

[51] Int. Cl.[7] ..... H01J 1/62

[52] U.S. Cl. ..... 313/567; 313/484; 313/637; 313/643

[58] Field of Search ..... 313/484, 567, 313/572, 637, 643

[56] References Cited

U.S. PATENT DOCUMENTS

| | | | |
|---|---|---|---|
| 5,212,424 | 5/1993 | Russell et al. | 313/562 |
| 5,498,928 | 3/1996 | Lapatovich et al. | 315/39 |
| 5,541,475 | 7/1996 | Wood et al. | 313/484 |

*Primary Examiner*—Vip Patel
*Attorney, Agent, or Firm*—Paul E. Steiner

[57] ABSTRACT

An electrodeless lamp includes a light transmissive envelope and a fill disposed in the envelope where the fill has the characteristic of emitting light when ignited and is excited by high frequency electrical energy provided by an R.F. or microwave source. The lamp includes a fill material enabling more reliable and effective ignition and shorter restrike intervals after an operating lamp has been extinguished. The fill includes a first component (preferably sulfur, selenium or a mixture of sulfur and selenium) and a second component (preferably xenon gas) included at a partial pressure in the range of 50 to 200 torr. A third component (preferably argon gas) is included at a partial pressure in the range of 5 to 20 torr. Preferably, approximately 5 torr of argon is added to a selected fill pressure of xenon (e.g., a partial pressure of 100 torr or more). The addition of a low partial pressure of argon provides unexpected improvements in starting and reduction in restrike time while maintaining a high lamp efficacy.

15 Claims, 1 Drawing Sheet

LAMP HAVING SPECIFIC FILL PROVIDING REDUCED RESTRIKE TIME

This appln claims benefit of provisional appln No. 60/055,293 filed Aug. 13, 1997 this appln is a 371 of PCT/US98/16822 filed Aug. 13, 1998.

BACKGROUND

1. Field of the Invention

The present invention pertains to improvements in high efficacy fill materials within bulbs of discharge lamps and has particular, although not limited, utility in lamps of the type disclosed in U.S. Pat. Nos. 5,404,076 and 5,606,220 (Dolan et al.) and PCT Publication WO 92/08240, the disclosures of which are incorporated herein by reference, in their entireties.

2. Related Art

Electrodeless lamps of the type with which the present invention is concerned are comprised of a light transmissive envelope containing a plasma-forming medium or fill. A microwave or radio frequency (RF) energy source has its output energy coupled to the envelope via a coupling waveguide to excite a plasma, resulting in a light discharge. In order to initiate breakdown (i.e., ignite the discharge), various techniques have been suggested. For example, in U.S. Pat. No. 4,359,668 (Ury), a supplemental ultraviolet igniter bulb, energized by extracting a portion of the primary microwave energy, emits energetic photons incident on the electrodeless lamp envelope. These photons ionize the fill within the envelope to effect the desired discharge therein.

Although ignition devices disposed outside the envelope can be effective, they consume space and add to the cost of the overall lamp. Even if an external or supplemental light source is used for starting, starting is not always reliable. It is desirable, therefore, to incorporate an additive in the fill material that has a low ionization potential and, therefore, facilitates initial breakdown so that the primary fill material can be ignited.

Other prior art systems used to assist lamp starting employ an arc discharge to free electrons through use of a conductive component to either concentrate a high strength electric field or introduce a concentrated field from an external power source. However, a system providing concentration or introduction of a high strength electric field requires additional components, thereby increasing cost.

Another approach involves the use of a fill additive which is partially electrically conductive at room temperature but non-conductive or a vapor at lamp operating temperatures. Such an approach is disclosed in U.S. Pat. No. 5,670,842 (Dolan, et al.).

FIG. 1 illustrates a typical configuration of an electrodeless lamp of the type with which the present invention is concerned. Specifically, a source or generator 16 generates microwave or RF energy and delivers the energy into a waveguide 18. The waveguide 18 directs the generated energy waves and couples the energy waves into a cavity 6, typically provided with a conductive mesh grid 8 for retaining the generated waves within the cavity 6 while allowing light waves to emanate therefrom. A transparent quartz bulb 10 in the cavity 6 is typically spherical or otherwise suitably configured and encloses a fill material containing sulfur and/or selenium, a trace amount of krypton-85 (e.g., 0.1 microcurie) and xenon gas and provides light when excited to form a plasma by the generated energy waves. The sulfur, selenium or sulfur/selenium mixture may be a solid having a low vapor pressure at room temperature and become gaseous with a high vapor pressure (e.g., two to twenty atmospheres) at typical lamp operating temperatures.

In operation, the radiation of the energy waves excites the fill atoms in the bulb 10 to effect a discharge of electrons. The discharged electrons collide with other fill atoms causing a further discharge of electrons, thereby increasing the total population of free electrons. The increased population of free electrons results in increased collisions and the process avalanches into radiation of light from a plasma. In the illustrated embodiment, the bulb 10 is connected by its elongate stem 12 to a motor 14 for rotating the bulb 10 about the longitudinal axis of the stem 12. In other embodiments, no mechanism for bulb rotation is required.

It is often necessary to restart or restrike the plasma ignition in a bulb as soon as possible after light discharge has been extinguished. Bulbs with fills of sulfur, selenium, a trace amount of krypton-85 and any quantity of xenon gas are difficult to start and difficult to restrike.

SUMMARY

The addition of a selected quantity (i.e., typically 50 torr or more partial pressure) of xenon provides lamps with a higher efficacy (about two to five percent higher) as measured in lumens per watt as compared to a similar fill with a comparable partial pressure of argon. However, as noted above, it is difficult to start bulbs containing xenon, and there is a corresponding difficulty in restarting or restriking the bulb after it has been operating and has become hot. Thus, when using xenon bulb fills, a significant time lag has been required before restriking, since the bulb must cool sufficiently to reduce internal pressure before restarting or restriking is possible.

It is an object of the present invention to provide an inexpensive and reliable bulb fill for enhancing ignition in electrodeless lamps without the use of additional circuitry.

According to the invention, an improved starting capability and/or a reduced restrike time can be obtained in discharge lamps, particularly, but not necessarily, lamps having sulfur and/or selenium fill with added xenon, by adding a surprisingly small amount (e.g. relatively low partial pressure) of argon gas into the bulb fill. Moreover, the fill of the present invention only minimally affects lamp efficacy (as measured in lumens per watt).

It is another object of the present invention to provide an additive to the primary fill in high efficacy electrodeless lamps for greatly enhancing the starting, ignition and restrike capability of the lamp.

It is yet another object of the present invention to greatly enhance the starting and restrike capability of the high efficacy lamp including the sulfur/selenium/xenon fill mixture which has been demonstrated to provide a high efficacy but also a high difficulty in starting.

The above objects are achieved individually and in combination, and it is not intended that the present invention be construed as requiring two or more of the objects to be combined unless expressly required by the claims attached hereto.

In one embodiment of the invention, a lamp bulb for a discharge lamp includes a light transmissive envelope and a fill disposed in the envelope. The fill has the characteristic of emitting light when excited by high frequency electrical energy. The fill includes a first component principally for emitting light, a second component having a selected fill pressure and a third component having a selected fill pressure, wherein the selected fill pressure of the second component is substantially greater than the selected fill pressure of the third component, and wherein the presence of the third component in the fill at its respective selected fill pressure causes a disproportionately large reduction in a breakdown strength of the fill. The first component may include, for example, sulfur, selenium or a mixture of sulfur and selenium. The second component includes a either xenon or krypton, preferably at a partial pressure in the range of about 50 to 200 torr. The third component includes either argon, neon, or helium at a lower partial pressure, preferably in the range of about 5 to 20 torr. The fill may also include a trace amount of a radioactive material, krypton-85, typically about 0.1 micro curies.

The above and still further objects, features and advantages of the present invention will become apparent upon consideration of the following detailed description of specific embodiments thereof, particularly when taken in conjunction with the accompanying drawing.

DESCRIPTION

Figure 1:
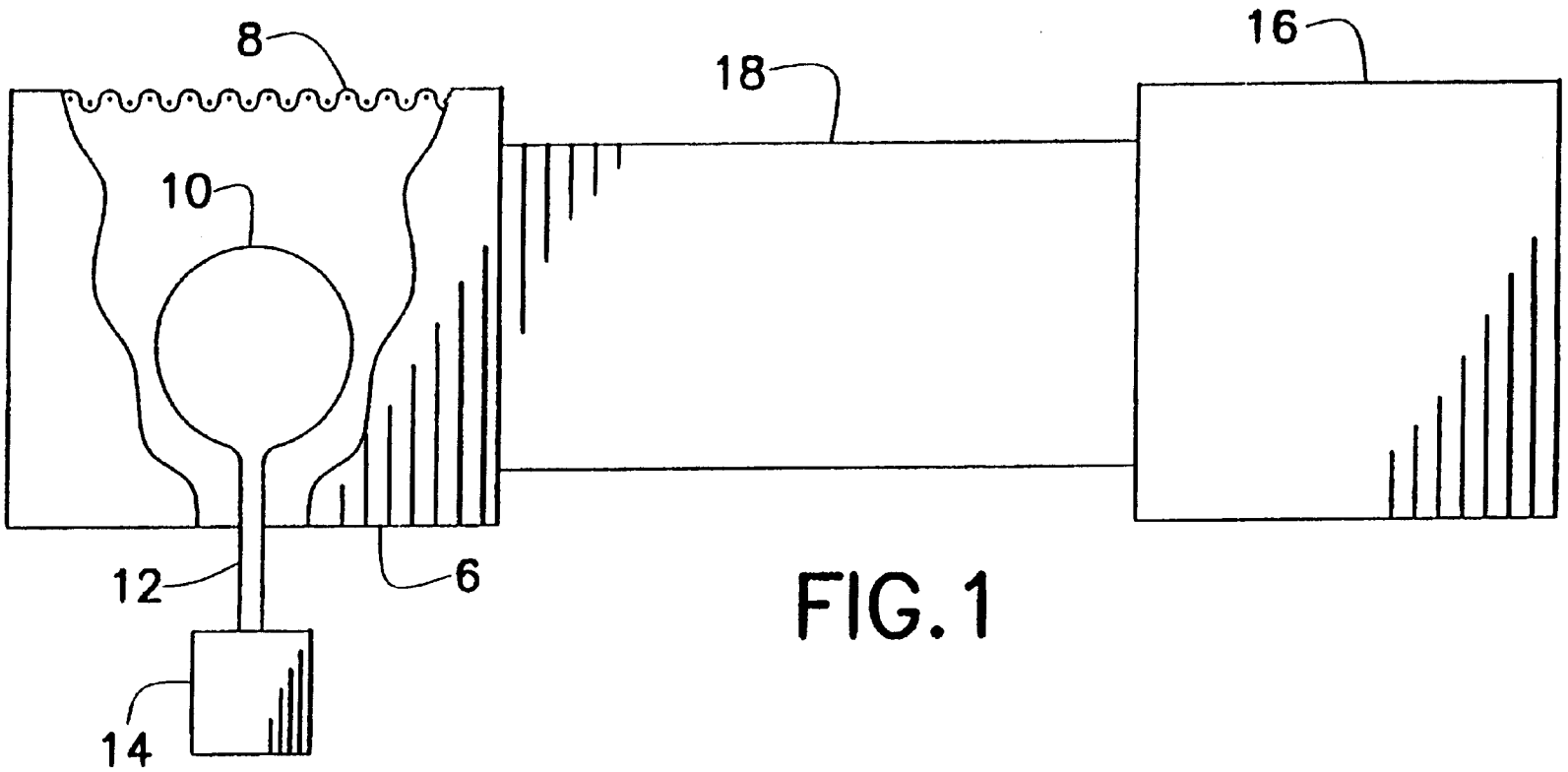
FIG. 1 is a block diagram of an electrodeless lamp having a bulb enclosing a fill material.

A necessary (but not sufficient) condition for igniting a discharge in a gas subjected to an electric field is that each free electron generates at least one other free electron before recombining and being lost to the discharge. The free electron density can then increase until reaching some limiting value. This phenomena is known as "Townsend Avalanche". One measure of the breakdown strength of a gas is the probability per unit path length that an electron will produce another free electron. This probability coefficient is a function of the electric field strength, the type of gas, and the gas density; therefore it is known that for electric field strengths and fill pressures typically used in an electrodeless lamp, argon has a higher probability coefficient than xenon. The probability coefficient for a mixture of gases should be, using conventional wisdom, something intermediate the values for each gas separately.

Thus, relying on the teachings of the prior art, one would expect that for each gas, the number of ionizing collisions should be proportional to the number of gas atoms and that the probability coefficient should vary linearly with gas mixture composition. For example, a mixture dominated by xenon should have breakdown characteristics similar to pure xenon and should show a gradual decline in breakdown strength as argon is added.

In accordance with the present invention, and surprisingly, an unexpectedly small addition of argon causes a disproportionately large reduction in breakdown strength in the sulfur/selenium/xenon bulb fill and allows more reliable and effective starting and quicker restrikes without a significant impact on efficacy. This highly advantageous result is not to be expected from study of the prior art.

Exemplary fill mixtures of xenon and argon include a broad range of selected quantities of xenon gas and argon gas. In the preferred embodiment, about 5 torr of argon is used with a selected fill pressure of xenon (e.g., a partial pressure of 100 torr or more) to provide both high reliability and high efficacy.

According to one embodiment of the present invention, more rapid and reliable ignition in the bulb 10 of FIG. 1 is accomplished by providing a fill within the bulb 10 including a first fill component (e.g., sulfur, selenium, or a mixture of sulfur and selenium), a second fill component (preferably xenon gas) at a selected fill pressure and a third component (preferably argon gas) at a selected fill pressure significantly less than the fill pressure of the second fill component. As noted above, the fill may also includes a trace amount of a radioactive material, krypton-85, typically about 0.1 micro curies.

Ferro-resonant power supplies produce higher peak powers which are useful in lamp starting. Switching power supplies are less expensive, smaller and lighter but do not provide the high peak power output. The use of a switching power supply exacerbates problems with starting and restriking since lamps are typically more difficult to start at lower voltages. Thus, the improved starting and restriking characteristics of the fill of the present invention is especially well suited for use in lamps having modern switching power supplies.

For illustration and comparison purposes, Tables 1–3 below list starting data for various embodiments of the invention. In each case, the same test bed was used. The bulb included a mixture of sulfur and selenium is provided in the same amount to provide a desirable color characteristic. The test bed included a switching power supply operating with a line voltage of 208V. Each bulb was energized by the source and the number of starts was recorded for the indicated quantity of bulbs. A given bulb is considered to start reliably if successful ignition was observed in every attempt for a selected number (usually five to ten) of attempts.

For each set of data, a bulb including 50 torr of xenon and no argon is provided as a baseline. A bulb with this fill generally started, although not always. Bulbs with higher pressures of xenon (e.g. 100, 150, or 200 torr) were not used as a baseline because at these higher pressures it is generally known that the bulb will not start reliably.

TABLE 1

| Gas Mix | | # of Bulbs | Normalized |
|---|---|---|---|
| Xe | Ar | Starting Reliably | LPW |
| 50 | 0 | 2/3 | 1.000 |
| 50 | 5 | 3/3 | 0.996 |
| 100 | 5 | 2/3 | 1.014 |
| 200 | 5 | 2/3 | 1.021 |

TABLE 2

| Gas Mix | | # of Bulbs | Normalized |
|---|---|---|---|
| Xe | Ar | Starting Reliably | LPW |
| 50 | 0 | 5/5 | — |
| 50 | 10 | 3/3 | — |
| 100 | 10 | 2/3 | — |
| 150 | 10 | 2/3 | — |

TABLE 3

| Gas Mix | | # of Bulbs | Normalized |
|---|---|---|---|
| Xe | Ar | Starting Reliably | LPW |
| 50 | 0 | 3/4 | 1.000 |
| 100 | 20 | 0/2 | 1.020 |
| 200 | 20 | 0/2 | 1.028 |

Similar results with a line voltage of 230 V are listed in Table 4:

TABLE 4

| Gas Mix | | # of Bulbs | Normalized |
|---|---|---|---|
| Xe | Ar | Starting Reliably | LPW |
| 50 | 0 | 0/1 | 1.000 |
| 50 | 10 | 1/1 | 0.982 |
| 100 | 10 | 1/1 | 0.997 |
| 150 | 10 | 0/1 | 1.022 |

Another aspect of the invention relates to measured restrike time for an extinguished lamp at near operating temperature (i.e., a hot bulb). Restrike time averaged 4.5 minutes for 50 torr Xenon bulbs and averaged 2.75 minutes for 50 torr Xenon/5 torr Argon bulbs (with a reflector attached and at 25° C. ambient temperature). Thus, the addition of 5 torr of Argon to the 50 torr Xenon lamp fill significantly reduced restrike time by an average of 1.75 minutes.

As can be seen from the above tables, bulb fills with higher pressures of xenon yield higher efficacies but are harder to start. The addition of low partial pressures of argon (e.g., about 5 torr) or a similar noble gas (e.g. neon or helium) aids in starting with only a small effect on lamp efficacy. Notably, this benefit extends to the reliable starting of very high pressure xenon (i.e. 100 torr or more) which would not otherwise be practical. Also, as noted above, the addition of low partial pressures of argon significantly reduces the restrike time.

It will be appreciated that the embodiments described above and illustrated in the drawing represent only a few of the many ways of implementing the efficient and easily started lamp of the present invention. Specifically, while the invention has been described with respect to a microwave excited electrodeless sulfur/selenium lamp, it is expected that the benefits of the invention are equally applicable to other fill components (e.g. mercury and metal halides), RF lamps (e.g. inductive and capacitive), and electroded lamps.

Having described preferred embodiments of a new and improved method and apparatus it is believed that other modifications, variations and changes will be suggested to those skilled in the art in view of the teaching set forth herein. It is therefore to be understood that all such variations, modifications and changes are believed to fall within the scope of the present invention as defined by the appended claims.

What is claimed is:

1. A lamp bulb for a discharge lamp, comprising:

a light transmissive envelope; and a fill disposed in the envelope, the fill having the characteristic of emitting light when excited by high frequency electrical energy, the fill including a first component principally for emitting light, a second component having a selected fill pressure and a third component having a selected fill pressure, wherein the selected fill pressure of the second component is substantially greater than the selected fill pressure of the third component, and wherein the presence of the third component in the fill at its respective selected fill pressure causes a disproportionately large reduction in a breakdown strength of the fill.

2. The lamp bulb as recited in claim 1, wherein the selected fill pressure of the second component is about 5 to 40 times greater than the selected fill pressure of the third component.

3. The lamp bulb as recited in claim 1, wherein the selected fill pressure of the second component is a partial pressure in the range of about 50 to 200 torr.

4. The lamp bulb as recited in claim 1, wherein the selected fill pressure of the third component is a partial pressure in the range of about 5 to 20 torr.

5. The lamp bulb as recited in claim 4, wherein the selected fill pressure of the third component is a partial pressure of about 5 torr.

6. The lamp bulb as recited in claim 1, wherein the first component pressure includes at least one member selected from the group of sulfur and selenium, the second component is one member selected from the group of xenon and krypton, and the third component is one member selected from the group of argon, neon, and helium.

7. A lamp bulb for a discharge lamp, comprising:

a light transmissive envelope; and a fill disposed in the envelope, the fill having the characteristic of emitting light when ignited and excited by high frequency electrical energy and including a first component principally for emitting light, a second component selected from the group of xenon and krypton at a partial pressure in the range of about 50 to 200 torr, and a third component selected from the group of argon, neon, and helium at a partial pressure in the range of about 5–20 torr.

8. The lamp bulb as recited in claim 7, wherein the presence of the third component in the fill causes a disproportionately large reduction in the breakdown strength of the fill.

9. A discharge lamp, comprising:

a source of high frequency energy;

a light transmissive envelope;

a fill disposed in the envelope, the fill having the characteristic of emitting light when excited by high frequency electrical energy, the fill including a first component principally for emitting light, a second component having a selected fill pressure and a third component having a selected fill pressure; and means for coupling the high frequency energy to the fill, wherein the selected fill pressure of the second component is substantially greater than the selected fill pressure of the third component, and wherein the presence of the third component in the fill at its respective selected fill pressure causes a disproportionately large reduction in a breakdown strength of the fill.

10. A method for improving starting characteristics in a discharge lamp having a bulb enclosing a fill including a first component principally for emitting light and a second component selected from the group of xenon and krypton having a selected fill pressure, the method including the step of:

adding a third component selected from the group of argon, neon, and helium at a selected pressure substantially less than the selected pressure of the second component.

11. The method of claim 10, wherein the selected pressure of the second component is at a partial pressure in the range of about 50 to 200 torr and the selected pressure of the third component is at a partial pressure in the range of about 5 to 20 torr.

12. The method of claim 11, wherein the second component is xenon and the third component is argon.

13. A method for reducing restrike time in a discharge lamp having a bulb enclosing a fill including a first component principally for emitting light and a second component selected from the group of xenon and krypton having a selected fill pressure, the method including the step of:

adding a third component selected from the group of argon, neon, and helium at a selected pressure substantially less than the selected pressure of the second component.

14. The method of claim 13, wherein the selected pressure of the second component is at a partial pressure in the range of about 50 to 200 torr and the selected pressure of the third component is at a partial pressure in the range of about 5 to 20 torr.

15. The method of claim 14, wherein the second component is xenon and the third component is argon.

* * * * *